US006467527B1

(12) United States Patent
Kubota et al.

(10) Patent No.: US 6,467,527 B1
(45) Date of Patent: Oct. 22, 2002

(54) PRESSURE DIE-CASTING PROCESS OF MAGNESIUM ALLOYS

(75) Inventors: Kohei Kubota, Saitama (JP); Koichi Satoh, Saitama (JP); Masaru Yamamoto, Yamanashi (JP); Yoichi Nosaka, Yamanashi (JP); Yasuhisa Goto, Yamanashi (JP); Takeshi Doi, Yamanashi (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 0 days.

(21) Appl. No.: 09/586,760

(22) Filed: Jun. 5, 2000

(30) Foreign Application Priority Data

| | | |
|---|---|---|
| Jun. 4, 1999 | (JP) | 11-157500 |
| Jun. 8, 1999 | (JP) | 11-161334 |
| Jun. 29, 1999 | (JP) | 11-183075 |

(51) Int. Cl.[7] ..... B22D 27/09
(52) U.S. Cl. ..... 164/113; 164/133
(58) Field of Search ..... 164/113, 61, 65, 164/133, 900

(56) References Cited

U.S. PATENT DOCUMENTS

| | | | | |
|---|---|---|---|---|
| 4,125,144 A | * | 11/1978 | Kawamoto et al. | 164/4 |
| 5,409,531 A | | 4/1995 | Deyama et al. | |
| 5,630,464 A | | 5/1997 | Bauman et al. | |
| 5,678,624 A | * | 10/1997 | Sakurai | 164/519 |
| 6,125,911 A | * | 10/2000 | Wust et al. | 164/4.1 |

FOREIGN PATENT DOCUMENTS

| | | | |
|---|---|---|---|
| EP | 0791662 A1 | | 8/1997 |
| GB | 2123326 A | | 2/1984 |
| JP | 54139831 | | 10/1979 |
| JP | 625790 | | 2/1994 |
| JP | 6200348 | | 7/1994 |
| JP | 711347 | | 1/1995 |
| SU | 1134289 A | * | 1/1985 |
| WO | WO9625529 | | 8/1996 |

OTHER PUBLICATIONS

Michael Avedsian, "Magnesium and Magnesium Alloys" May 1999, ASM International, pp. 66–77.*
Heine, Richard, "Principles of Metal Casting" 1955, McGraw Hill Book Company, Inc.*
M.M. Avedesian et al., "Magnesium and Magnesium Alloys," May 2000, ASM International, pp. 66–77.
D.M. Stefanescu et al., Metals Handbook, 9$^{th}$ Edition, vol. 15 Casting, 1988, ASM International, Lionel J.D. Sully, "Die Casting," pp. 296–295.
J.F. King, Magnesium Alloys and their Applications, 1988, "Development of Magnesium Diecasting Alloys," pp. 37–47.
H. Haferkamp et al., "Advanced Technology for Cold Chamber Die Casting of Magnesium Alloys," Magnesium Alloys and their Applications, 1998, pp. 501–506.

* cited by examiner

*Primary Examiner*—M. Alexandra Elve
*Assistant Examiner*—Len Tran
(74) *Attorney, Agent, or Firm*—Young & Thompson

(57) ABSTRACT

A method for die-casting a magnesium alloy comprises the step of casting a die cast product free of any hot tearing, shrinkage tearing and shrinkage cavity starting from a magnesium alloy comprising i) 1 to 10% by weight of aluminum; ii) at least one member selected from the group consisting of 0.2 to 5% by weight of a rare earth metal, 0.02 to 5% by weight of calcium and 0.2 to 10% by weight of silicon; and iii) not more than 1.5% by weight of manganese, and the balance of magnesium and inevitable impurities, using a cold chamber type die-casting machine, wherein a) the temperature of the molten magnesium alloy is maintained at 650 to 750°C.; b) the charging velocity of the molten metal is set at 1/100 to 10/100 second; and c) the intensified pressure after the charging is set at a level of not less than 200 kgf/cm$^2$. Thus, a die cast product free of any hot tearing, shrinkage tearing and shrinkage cavity can be produced by appropriately specifying injection conditions, mold conditions, conditions for melting a magnesium alloy and mold plan in the cold chamber type die-casting machine, or by appropriately controlling the temperature of the molten metal from the molten metal-accommodating pot to the gate portion of the machine.

16 Claims, No Drawings

PRESSURE DIE-CASTING PROCESS OF MAGNESIUM ALLOYS

BACKGROUND OF THE INVENTION (a) Field of the Invention

The present invention relates to a process for pressure die-casting a magnesium alloy excellent in the low-temperature strength and high-temperature strength and more specifically to a process for pressure die-casting a magnesium alloy having sufficient strength even at a high temperature up to about 523K, which is required for reducing the weight of, for instance, parts for motorcar engines.

(b) Description of the Prior Art

There has recently been required for the improvement in the fuel consumption of motorcars because of the increased demand for the environmental protection of the earth and accordingly, there has strongly been required for the development of lightweight materials for motorcars.

The magnesium alloy has the lowest density among the metal materials, which have recently been put into practical use, and has intensively been expected as a future lightweight material for motorcars. The magnesium alloys, which have most commonly been used, are Mg—Al—Al—Mn alloys such as AZ91 alloys (Mg—9Al—0.7Zn—0.2Mn) or AM50 alloys (Mg—5Al—0.2Mn). The peripheral techniques such as the techniques for casting these alloys have almost been completely established and therefore, this alloy has, first of all, been investigated in order to reduce the weight of motorcars.

However, the strength of these alloys are reduced at a temperature of not less than 393K and these magnesium alloys are not suitable for the applications such as parts of engines, which must have desired heat resistance and creep resistance at a temperature of up to about 473K. Under such circumstances, there have been developed magnesium alloys, to which silicon is added, such as AS41 (Mg—4Al—1Si—0.2Mn); those, to which rare earth metals are added, such as AE42 alloys (Mg—4Al—2RE—0.2Mn (wherein RE represents a rare earth metal)). Moreover, there has more recently been developed and proposed magnesium alloys, to which calcium is added (Japanese Un-Examined Patent Publication (hereunder referred to as "J.P. KOKAI") No. Hei 6-25790); and those containing calcium and rare earth metals (J.P. KOKAI Nos. Hei 6-200348 and Hei 7-11347).

All of these magnesium alloys possess the predetermined heat resistance and creep resistance required for the parts of motorcar engines whose temperature is raised up to about 473K or even to a level on the order of about 523K, but they have not been widely used practically except for a part thereof. This is because these alloys are susceptible to hot tearing, shrinkage tearing and/or are liable to form shrinkage cavities and further suffer from problems such as the entrainment of oxides and the formation of film play (wrinkles) on the surface of castings. More specifically, elements such as silicon, rare earth metals and calcium are quite active and they are liable to form oxides and compounds are formed at grain boundaries. For this reason, it would be assumed that these alloys are highly susceptible to hot tearing and shrinkage tearing. However, the most fundamental cause of these drawbacks would be such that there has not yet been elucidated any casting conditions, while taking measures to eliminate these problems.

SUMMARY OF THE INVENTION

The present invention has been developed to solve the problems associated with the conventional techniques for developing lightweight materials for motorcars and accordingly, it is an object of the present invention to provide a process for casting, according to the pressure die-casting (hereunder simply referred to as "die-casting") process, a die cast product, which is free of any hot tearing, shrinkage tearing and/or shrinkage cavity, using a cold chamber type die-casting machine, starting from a high temperature magnesium alloy, which is suitable as a material for preparing parts for motorcar engines, which should satisfy both requirements for high temperature strength and low temperature strength.

The inventors of this invention have conducted various studies to accomplish the foregoing object. As a result, the inventors have found that the problems concerning hot tearing, shrinkage tearing and shrinkage cavity conventionally observed when casting a high temperature magnesium alloy can be solved and the problems concerning the entrainment of oxides and the formation of film play on the surface of castings can also be solved, by casting a die cast product from a magnesium alloy having a specific alloy composition under specific casting conditions using a cold chamber type die-casting machine. Consequently, the inventors have completed the present invention on the basis of the foregoing finding.

According to a first aspect of the present invention, there is provided a die-casting process for casting a magnesium alloy, which is a method for casting a die cast product free of any hot tearing, shrinkage tearing and formation of shrinkage cavities, starting from a magnesium alloy, which comprises i) 1 to 10% by weight of aluminum; ii) at least one member selected from the group consisting of 0.2 to 5% by weight of a rare earth metal, 0.02 to 5% by weight of calcium, and 0.2 to 10% by weight of silicon and iii) not more than 1.5% by weight of manganese and the balance of magnesium and inevitable impurities, using a cold chamber type die-casting machine, wherein a) the temperature of the molten magnesium alloy is maintained at 650 to 750° C.; b) the charging velocity of the molten metal is set at $1/100$ to $10/100$ sec; and c) the intensified pressure after the charging is set at a level of not less than 200 kgf/cm$^2$.

According to a second aspect of the present invention, there is provided a die-casting process for casting a magnesium alloy, which is a method for casting a die cast product free of any hot tearing, shrinkage tearing and formation of shrinkage cavities, starting from a magnesium alloy, which comprises i) 1 to 10% by weight of aluminum; ii) at least one member selected from the group consisting of 0.2 to 5% by weight of a rare earth metal, 0.02 to 5% by weight of calcium, and 0.2 to 10% by weight of silicon and iii) not more than 1.5% by weight of manganese and the balance of magnesium and inevitable impurities, using a cold chamber type die-casting machine, wherein d) the temperature of the mold is maintained at 150 to 350° C. e) the surface temperature of the mold at its cavity portions in which the die cast product is susceptible to shrinkage tearing is reduced by not less than 10K compared with the temperature of the peripheral portions of the mold; f) the air pressure in the mold during the die-casting step is controlled to a level of not more than 100 mmHg; and g) an additive for a releasing agent to be applied onto the internal wall of the mold is at least one member selected from the group consisting of graphite, BN, water glass, mica, silica gel, magnesium hydroxide and magnesium oxide.

According to a third aspect of the present invention, there is provided a die-casting process for casting a magnesium alloy, which is a method for casting a die cast product free of any hot tearing, shrinkage tearing and formation of shrinkage cavities, starting from a magnesium alloy, which comprises i) 1 to 10% by weight of aluminum; ii) at least one member selected from the group consisting of 0.2 to 5% by weight of a rare earth metal, 0.02 to 5% by weight of calcium, and 0.2 to 10% by weight of silicon and iii) not more than 1.5% by weight of manganese and the balance of magnesium and inevitable impurities, using a cold chamber type die-casting machine, wherein any oxidation of the molten magnesium alloy is inhibited, the flowability of the molten metal is improved and the entrainment of oxides and the formation of film play are prevented by h) using a melting furnace in which a closed protective atmosphere for inhibiting combustion and oxidation is established over the surface of the molten magnesium alloy and i) pumping out the molten magnesium alloy at a portion not less than 100 mm apart from the surface of the molten alloy.

The die-casting method for casting a magnesium alloy according to the present invention may be carried out by combining at least two of the foregoing three embodiments according to the first to third aspects of the present invention. More specifically, the die-casting method for casting a magnesium alloy is a method, which comprises casting a die cast product free of any hot tearing, shrinkage tearing and formation of shrinkage cavities using a cold chamber type die-casting machine and starting from a magnesium alloy, which comprises:

i) 1 to 10% by weight of aluminum;

ii) at least one member selected from the group consisting of 0.2 to 5% by weight of a rare earth metal, 0.02 to 5% by weight of calcium and 0.2 to 10% by weight of silicon; and iii) not more than 1.5% by weight of manganese; and the balance of magnesium and inevitable impurities, can be carried out by arbitrarily combining the following three groups of conditions:

(I) Injection Conditions:

a) the temperature of the molten magnesium alloy is maintained at 650 to 750° C.;

b) the cavity-charging velocity is set at a level of 1/100 to 10/100 sec; and c) the intensified pressure applied after the charging is set at a level of not less than 200 kgf/cm$^2$;

(II) Mold Conditions:

d) the mold temperature is maintained at 150 to 350° C.;

e) the temperature of the mold surface at cavity portions in which the die cast product is susceptible to shrinkage tearing is set at a level of not less than 10K higher than that of the peripheral portions thereof;

f) the air pressure within the mold during the die-casting step is controlled to not more than 100 mmHg; and g) an additive for a releasing agent to be applied onto the inner wall of the mold is at least one member selected from the group consisting of graphite, BN, water glass, mica, silica gel, magnesium hydroxide and magnesium oxide;

(III) Conditions for Melting the Magnesium Alloy:

h) using a closed melting furnace in which a protective atmosphere for inhibiting combustion and oxidation is established over the surface of the molten magnesium alloy; and i) pumping out the molten magnesium alloy at a position not less than 100 mm apart from the surface of the molten alloy, to thus inhibit any oxidation of the molten magnesium alloy, to improve the flowability thereof and to inhibit any entrainment of oxides and formation of film play.

According to a fourth aspect of the present invention, there is provided a process for casting a die cast product free of any hot tearing, shrinkage tearing and formation of shrinkage cavities, which comprises the step of preparing a die cast product starting from a magnesium alloy comprising:

i) 1 to 10% by weight of aluminum;

ii) at least one member selected from the group consisting of 0.2 to 5% by weight of a rare earth metal, 0.02 to 5% by weight of calcium and 0.2 to 10% by weight of silicon; and iii) not more than 1.5% by weight of manganese; and the balance of magnesium and inevitable impurities, using a cold chamber type die-casting machine, wherein the process is characterized by maintaining the temperature of the molten magnesium alloy at the gate portion of the cold chamber type die-casting machine to the range of from 590 to 720° C. and maintaining the difference in temperature between the molten metal present in a molten metal-containing pot and the molten metal at the gate portion to not more than 105K.

DESCRIPTION OF THE PREFERRED EMBODIMENTS

We will hereunder explain, more in detail, the composition of the magnesium alloy used in the die-casting process according to the present invention; the injection conditions and mold conditions in the die-casting process; conditions for melting the magnesium alloy; and the mold plan.

The magnesium alloy used in the die-casting process according to the present invention comprises:

i) 1 to 10% by weight of aluminum;

ii) at least one member selected from the group consisting of 0.2 to 5% by weight of a rare earth metal, 0.02 to 5% by weight of calcium and 0.2 to 10% by weight of silicon; and iii) not more than 1.5% by weight of manganese; and the balance of magnesium and inevitable impurities. Specific examples thereof include Mg—5Al—2Ca—2RE—0.2Mn; Mg—5Al—4Ca—0.2Mn; Mg—5Al—4RE—0.2Mn; Mg—5Al—8Si—0.2Mn; Mg—9Al—2RE—1Si—0.05Ca—0.02Mn; Mg—5Al—0.5RE—0.1Si—0.1Ca—0.02Mn; and Mg—2Al—2Ca—0.2Mn.

A cold chamber type die-casting machine is used in the die-casting process of the present invention. This is because the hot chamber type die-casting machine is provided with an injection member of iron, which is to be immersed in a molten metal and the member may undergo a reaction with alloys containing rare earth metals and/or calcium having high affinities for iron and accordingly, this would cause various problems such as adhesion of a plunger to sleeve. In particular, magnesium alloys having a low aluminum content, for instance, those having an aluminum content ranging from 2 to 6% by weight have often been used and in such cases, the use of a hot chamber type die-casting machine makes it difficult to cast a die cast product if the casting temperature is increased to not less than 650° C.

The injection conditions for the die-casting process of the present invention include the temperature of a molten metal. If the temperature of the molten metal in a melting furnace is less than 650° C., the flowability of the molten metal is reduced and a problem arises, which relates to the mold-charging ability. On the other hand, it exceeds 750° C., there is a high risk of catching a fire during holding the molten metal and the resulting die cast product may easily cause hot tearing and shrinkage tearing since the shrinkage factor increases when the molten metal is solidified. Therefore, the temperature of the molten alloy should be maintained to the range of from 650 to 750° C. and desirably 650 to 710° C.

The charging velocity is one of the injection conditions in the die-casting process according to the present invention. In general, the magnesium alloy has a low latent heat of solidification and therefore, it has been recommended to increase the injection velocity. The magnesium alloy used in the present invention is liable to cause cracking due to the formation of compounds, in particular, at the grain boundary in which the rate of solidification is relatively low and therefore, it is essential to apply a casting pressure to the entire region of castings. For this reason, the balance between the casting velocity and the cooling through the mold wall should be taken into consideration and empirically, it is essential to control the velocity of charging the molten metal into the mold cavity to 1/100 to 10/100 second and desirably 1/100 to 5/100 second. To satisfy such requirements, the injection velocity is adjusted to not less than 2 m/sec and desirably not less than 3.5 m/sec or the gate velocity is adjusted to not less than 30 m/sec and desirably not less than 50 m/sec. If the time required for charging the molten metal into the mold cavity (mold-charging velocity) is longer than 10/100 sec, a problem arises, which relates to either the mold-charging ability (insufficient charging) or the hot tearing properties.

The intensified pressure after charging is also one of the injection conditions in the die-casting process according to the present invention. It is necessary to prevent any insufficient charging and to inhibit hot tearing and shrinkage tearing when the molten metal is cooled and solidified by applying an intensified pressure to the mold cavity immediately after the charging of the molten metal into the cavity. At this stage, the intensified pressure is not less than 200 $kgf/cm^2$ and desirably not less than 400 $kgf/cm^2$. If such an intensified pressure is not applied, the charging of the mold cavity is insufficient and there is observed cracks over the whole region in which the thickness of castings is changed.

The foregoing die cast injection conditions are correlated to one another and all of these conditions are essential to obtain acceptable thin castings of the magnesium alloy. More specifically, a magnesium alloy die cast product free of any hot tearing, shrinkage tearing and formation of shrinkage cavities can be obtained only when all of the following three requirements are satisfied:

a) The temperature of the molten magnesium alloy is maintained at 650 to 750° C.;
b) The rate of charging the molten metal into the mold cavity is adjusted to 1/100 to 10/100 second; and
c) The intensified pressure after the charging is set at a level of not less than 200 $kgf/cm^2$.

The temperature of the mold is one of the mold conditions in the die-casting process according to the present invention. If the mold temperature is less than 150° C., it has empirically been found that the molten metal-charging ability is impaired and that a problem arises, which relates to the surface properties of the resulting castings such as film play even when the molten metal can be charged into the mold cavity. On the other hand, if the mold temperature exceeds 350° C., the resulting castings are susceptible to shrinkage tearing and hot tearing because of a low solidification velocity. Accordingly, the mold temperature is maintained at 150 to 350° C. and desirably 180 to 280° C.

Another mold condition in the die-casting process according to the present invention is local cooling. The castings may be liable to cause cracks at portions in which the thickness thereof is abruptly changed, depending on the shapes of the castings. In such cases, the temperature should locally be controlled in addition to the foregoing overall control of the mold temperature. This local temperature control may be carried out by, for instance, providing the mold with passages for a coolant at desired portions and passing a coolant such as water, an oil or air through the passages to thus cool the predetermined portions or by spraying a releasing agent or air on the predetermined portions of the resulting castings immediately after opening the mold. In any case, the surface temperature of the portions which require such local cooling should be reduced to a level of not less than 10K and desirably not less than 20K lower than that of the peripheral region of the mold in order to preferentially solidify the portions susceptible to shrinkage tearing and to thus inhibit any shrinkage tearing of the resulting castings.

The pressure reduction in the mold is also one of the foregoing mold conditions in the die-casting process according to the present invention. The pressure in the mold must be reduced for the purpose of assisting the charging of a molten metal into the mold cavity simultaneous with the inhibition of any turbulence of the molten metal flow due to the air in the mold. To this end, it is necessary to control the air pressure in the mold upon injection of the molten metal to not more than 100 mmHg and desirably not more than 50 mmHg.

A releasing agent to be applied onto the inner wall of the mold also serves as one of the mold conditions. As to cooling conditions for solidifying the molten metal, the releasing agent has a thermal insulation effect, which may delay the solidification of the molten metal to thus exert a casting pressure on the molten metal, in addition to the mold temperature conditions. To this end, it is quite effective to use at least one additive for the releasing agent, selected from the group consisting of graphite, BN, water glass, mica, silica gel, magnesium hydroxide and magnesium oxide.

The foregoing mold conditions are correlated with one another, but the mold temperature condition is particularly important. In cases where a mold is completely free of any cavity portion susceptible to cause cracks in the die cast product, any local cooling can be omitted and therefore, the local cooling is excluded from the essential elements of the present invention. The pressure reduction in the mold and the use of additives for the releasing agent are not always necessary requirements, but better results can be obtained by the simultaneous use of these requirements.

The present invention permits the casting of a die cast product of a magnesium alloy, which is free of any hot tearing, shrinkage tearing and formation of any shrinkage cavities, if these four mold conditions are completely satisfied:

d) the mold temperature is maintained at 150 to 350° C.;
e) the temperature of the mold surface at cavity portions in which the die cast product is susceptible to shrinkage tearing is set at a level of not less than 10K higher than that of the peripheral portions thereof;
f) the air pressure within the mold during the die-casting step is controlled to not more than 100 mmHg; and
g) an additive for a releasing agent to be applied onto the inner wall of the mold is at least one member selected from the group consisting of graphite, BN, water glass, mica, silica gel, magnesium hydroxide and magnesium oxide.

The magnesium alloys used in the present invention comprise at least one member selected from the group consisting of rare earth metals, calcium and silicon. All of these elements are very active and therefore, make the combustibility and oxidizability of the magnesium alloy higher. For this reason, a protective atmosphere for inhibiting combustion and oxidation is established over the surface of the molten magnesium alloy as one of the melting conditions for the magnesium alloys in the die-casting process according to the present invention. To this end, there is used a closed melting furnace in which a protective atmosphere for inhibiting combustion and oxidation is established over the surface of the molten magnesium alloy. Examples of such protective atmospheres include those comprising dried air, $CO_2$, $N_2$, to which at least one of $SF_6$ and $SO_2$ is added in an amount of not less than 1% by volume; and gases inert to the molten magnesium alloys such as Ar, $CO_2$, He, Ne, $N_2$ and dried air and these gases are passed over the surface of the molten alloys. If an open type melting furnace is used, the molten magnesium alloy is oxidized and there are observed entrainment of these oxides into the molten alloy and the flowability of the molten alloy is impaired.

In the die-casting process of the present invention, the die-casting operation is carried out using a cold chamber type die-casting machine and therefore, it is necessary to pump out the molten metal from the melting furnace and to transport the same to a sleeve portion of the cold chamber type die-casting machine. If the molten metal is pumped out from a portion near the surface thereof, oxides and/or dross may be entrained into the molten metal pumped out.

As one of the melting conditions in the die-casting process according to the present invention, the molten metal is not pumped out from the furnace at a portion near the surface on which oxides float, but at a position not less than 100 mm apart from the surface through a tube, in order to prevent any entrainment of the oxides. In addition, it is also desirable that the molten metal be pumped out at a position not less than 100 mm apart from the bottom on which intermetallic compounds are deposited to thus prevent any entrainment of such intermetallic compounds. The term "tube" herein used includes tubes fitted to the pumping out parts of automatic molten metal-supply devices such as a siphon and a mechanical pump.

Surface coating of a pot is also one of the melting conditions for the magnesium alloy in the die-casting process of the invention. The molten magnesium alloy is quite reactive with iron and the molten metal is severely oxidized at the contact area between the pot surface, the molten metal and air. Therefore, the reaction of the molten metal with iron is inhibited and the wettability of the pot surface by the molten metal is reduced to thus inhibit any oxidation of the molten metal in the contact area between the pot and the molten metal, by plating aluminum on the surface of the melting pot, in particular, in the contact area between the pot surface and the surface portion of the molten metal or by application or thermal spraying of BN or TiN on such a portion or by treating the portion according to the combination thereof.

The foregoing melting conditions are correlated with one another, but the surface coating of the pot is not an essential requirement since any entrainment of oxides can be inhibited if the molten metal is pumped out by the foregoing method. However, the simultaneous use of such essential elements is preferred since better results can be obtained.

In the present invention, if these melting conditions for the magnesium alloy specified below are satisfied:

h) using a closed melting furnace in which a protective atmosphere for inhibiting combustion and oxidation is established over the surface of the molten magnesium alloy;

i) pumping out the molten magnesium alloy at a position not less than 100 mm apart from the surface of the molten alloy; and optionally j) plating aluminum on the surface of the melting pot, in particular, in the contact area between the pot surface and the surface portion of the molten metal or by application or thermal spraying of BN or TiN on such a portion or by treating the portion according to the combination thereof; any oxidation of the molten magnesium alloy can be inhibited, the flowability thereof can be improved and any entrainment of oxides and formation of film play can be prevented to thus give a die cast product of a magnesium alloy free of any hot tearing, shrinkage tearing and formation of shrinkage cavities.

The die-casting process of the present invention can be practiced by combining any two or three conditions selected from the foregoing three kinds of conditions, i.e., the injection conditions, mold conditions and the conditions for melting the magnesium alloy and in these cases, better results can be ensured.

Moreover, in the die-casting process of the present invention, the problems such as the generation of, for instance, penetration, insufficient charging, hot tearing, shrinkage tearing, film play and shrinkage cavity associated with the die-casting of magnesium alloys can more certainly be solved or eliminated by appropriately adjusting the scheme of molding or casting in addition to the appropriate control of the foregoing injection conditions and/or mold conditions and/or magnesium alloy-melting conditions.

The inventors of this invention have variously investigated the rationalization of the mold plan to be adopted in the die-casting process for magnesium alloys and as a result, have found that there are some rules to be taken into consideration. More specifically, it is quite important, in the die-casting of a magnesium alloy, to pour the molten metal into the mold cavity in such a manner that the following requirements are satisfied: the molten metal is poured into the mold cavity (1) as a smooth molten metal flow free of any turbulence, (2) without causing any reduction in the flow rate, (3) as a flow having a constant velocity and the highest possible linearity, (4) without causing any mutual disturbance between flows and (5) by rapidly charging the molten metal into the mold cavity. Thus, the foregoing problems such as the generation of any penetration, insufficient charging of the molten metal, hot tearing, shrinkage tearing, film play and shrinkage cavity can certainly be solved or eliminated by the combination of the adoption of the optimized molding scheme with the rationalization of the foregoing injection and/or mold and/or magnesium alloy-melting conditions.

In the mold plan preferably adopted in the die-casting process of the present invention, a plurality of gates are provided, runners directly connected to every gates through the sprue and the distance of the non-gate portion between the neighboring two gates is set at a level of not more than 10 mm except for cases wherein such a plan is not impossible from the viewpoint of the mold plan.

In another mold plan preferably adopted in the die-casting process according to the present invention, the mold is planed such that the mold satisfies at least one of the following requirements, in combination with the aforementioned requirements: The volume of each runner connecting the sprue to each gate is identical to those of the other runners; the cross sectional area of each gate is planed such that it is proportional to the volume of the mold to be charged; the total cross sectional area of each runner extending from the sprue to each gate is maintained at a constant level in the direction of the molten metal flow or continuously reduced along the direction; and the runner is planed so as to have a shape of not less than; R5 as much as possible in order to make the molten metal flow smooth.

In a further mold plan preferably adopted in the die-casting process of the present invention, the mold is further preferably planed such that it satisfies the following requirement in addition to either or both of the foregoing requirements: The velocity of the molten metal, which flows from the gate to the mold cavity, is set in such a manner that the velocity difference in the direction of the gate width is not more than 1 m/sec on the basis of the measurement or calculation of the molten metal flow.

In a still further mold plan preferably adopted in the die-casting process of the present invention, it is a prior condition to provide a plurality of gates. In such a mold plan provided with a plurality of gates, it is first necessary that the sprue is directly connected to each runner so as not to disturb the flow rate of the molten metal and the molten metal flow or that the sprue is directly connected to each separate runner. Moreover, at least two gates are disposed to make the molten metal flow in each runner uniform and to simultaneously establish the cross sectional area of the gate in proportion to the shape of the molded product. However, the final number of gates and the cross sectional area of each gate are determined by the size and shape of the product and thus restricted by, for instance, the size of the mold, the cost of the mold and the shrinkage factor of the material. However, it is rather desirable to adopt a multi-gate structure and to make the gate diameter small depending on the shape of the product while taking into consideration only the mold plan.

The runners and each gate disposed in such a manner should satisfy or preferably satisfy several basic plan conditions so that the molten metal is charged into the mold cavity without disturbing the molten metal flow as much as possible as has been discussed above. In other words, to charge the molten metal into the mold cavity without any disturbance of the meld flow, it is preferred that the runners connecting the sprue to at least two gates be so planed as to make the volumes of the runners identical to one another and that the molten metal be simultaneously charged into the mold cavity through the plurality of gates by establishing the cross sectional area of each gate such that it is proportional to the volume of the mold cavity to be charged through the gate.

In addition, it is also preferred that the total cross sectional area of each runner, which connects the sprue to each gate be kept constant in the direction of the molten metal flow or continuously reduced so as not to reduce the flow rate of the molten metal (or melt) . The runner is so planed that it has a shape of not less than R5 as much as possible, in order to make the molten metal flow smooth.

If the molten metal is straightly and rapidly charged into the mold cavity through the gates as has been discussed above, cold shut is easily generated between gates. Therefore, when adopting the foregoing mold plan, it is essential that the distance of the non-gate portion between the neighboring gates be controlled to not more than 10 mm except for cases in which the establishment of such a distance is forbidden from the viewpoint of the plan.

Moreover, velocity vectors of the molten metal flow other than those vertical to the cross section of the gate are generated in the widthwise direction of each gate, depending on the R of the runners. For this reason, the molten metal velocity vertical to the cross section of the gate is reduced at the edge portion of the gate, in the velocity distribution in the widthwise direction of the gate. Therefore, it is desirable that the velocity difference in the velocity distribution along the widthwise direction of the gate be controlled to a level of not more than 1 m/sec on the basis of the measurement or the molten metal flow calculation, so as to make the velocity distribution uniform as much as possible. In this connection, the foregoing cold shut between gates would easily be generated as the velocity difference in this distribution approaches 0 and therefore, the tendency of the molten metal flow at the edge portion of the gate should fully be investigated.

Furthermore, the $4^{th}$ embodiment of the present invention relates to a die-casting process for preparing a die cast product free of any hot tearing, shrinkage tearing and formation of shrinkage cavities, using a cold chamber type die-casting machine starting from a magnesium alloy. The magnesium alloy used herein comprises the following components:

i) 1 to 10% by weight of aluminum;

ii) at least one member selected from the group consisting of 0.2 to 5% by weight of a rare earth metal, 0.02 to 5% by weight of calcium and 0.2 to 10% by weight of silicon; and iii) not more than 1.5% by weight of manganese; and iv) the balance of magnesium and inevitable impurities.

The process is characterized by maintaining the temperature of the molten magnesium alloy at the gate portion of the cold chamber type die-casting machine to the range of from 590 to 720° C. and maintaining the difference in temperature between the molten metal present in a molten metal-containing pot and the molten metal present in the gate portion to not more than 105K.

In the $4^{th}$ embodiment of the die-casting process of the present invention, it is important to maintain the molten magnesium alloy temperature to not less than 590° C. at the gate portion of the cold chamber type die-casting machine, in order to ensure desired flowability and charging ability of the molten magnesium alloy, to ensure the surface properties of the resulting castings, to inhibit the generation of any hot tearing, shrinkage tearing and formation of any shrinkage cavity and to produce a magnesium die cast product of high quality at a lower price.

To maintain the molten metal temperature at the gate portion at not less than 590° C., it is necessary to increase the temperature of the molten metal present in the molten metal-containing pot (or molten metal-containing furnace), but the temperature should be limited to less than 750° C. from the viewpoint of safety. In addition, the molten magnesium alloy is inevitably cooled during the transfer thereof from the molten metal-containing pot to the gate portion. Moreover, the higher the temperature of the molten metal present in the pot, the higher the degree of cooling of the molten metal. Thus, the reduction of the degree of cooling of the molten metal requires additional facilities and cost. For this reason, it would be realistic to maintain the temperature of the molten magnesium alloy, at the gate portion, at not more than 720° C.

Consequently, in the die-casting process according to the present invention, the temperature of the molten magnesium alloy at the gate portion of the cold chamber type die-casting machine is maintained at 590 to 720° C.

Moreover, if the degree of cooling of the molten metal is high in the intermediate stage extending from the molten metal-containing pot to the gate portion, a part of the molten magnesium alloy begins to solidify in the sleeve during the intermediate stage and the flowability of the molten metal is impaired. In addition, the degree of oxidation is high in the intermediate stage. Accordingly, the difference in temperature between the molten metal present in the molten metal-containing pot and that in the gate portion should be controlled to not more than 105K and desirably not more than 60K.

The inventors have intensively investigated means for practically reducing the extent of cooling of the molten metal in the intermediate stage extending from the molten metal-containing pot to the gate portion. As a result, the inventors have found that it is possible to transfer the molten metal to the position just above the sleeve while maintaining the temperature of the molten metal at a level almost identical to that of the molten metal in the pot by adopting an automatic molten metal supply system as the molten metal supply-molten metal-pouring system. Such automatic molten metal supply systems usable herein are, for instance, siphon type, mechanical pump type, reduced pressure type or pressurized pump type, or electromagnetic pump type ones. These automatic molten metal supply systems are well-known in the art and these well-known automatic molten metal supply systems can be used in the present invention without any modification.

To reduce the extent of cooling of the molten metal in the intermediate stage defined above, the sleeve of the cold chamber type die-casting machine is preferably produced using a material whose thermal conductivity is not more than 0.085 cal/cm·s·°C. and is also preferably so planed as to have a thickness of not less than 10 mm to thus improve the heat retaining properties. In addition, it is preferred that the sleeve is heated to a temperature of not less than 100° C. and desirably not less than 250° C. and it is maintained at that temperature to thus maintain the desired temperature of the molten metal present in the sleeve portion.

Examples of materials for such a sleeve are hot tool steels such as SKD61 (thermal conductivity: 0.085 cal/cm·s·°C.); those obtained by thermally spraying, on these hot tool steels, ceramics having low thermal conductivity or composite materials of ceramics and metals to reduce the overall thermal conductivity of the resulting sleeve; or those obtained by depositing, on these hot tool steels, a coating layer of, for instance, TiC, TiCN, CrC, $W_2$ C, TiN, TiCrN and/or CrN according to, for instance, the CVD technique; ceramics such as SiN, Sialon, $ZrB_2$, $Al_2O_3$ and SiC; or those obtained by treating iron-based or titanium-based substrates with the foregoing ceramics.

Further, to reduce the extent of cooling of the molten metal in the intermediate stage defined above, it is also effective to maintain the temperature of the molten metal present in the runner extending from the sprue to the gate portion by maintaining the temperature of the runner at not less than 150° C. and desirably 180 to 350° C. and simultaneously to apply, to the runner, at least one member selected from the group consisting of graphite, BN, water glass, mica, silica gel, magnesium hydroxide and magnesium oxide, which are excellent in the heat-retaining properties or to apply, to the runner, a releasing agent to which at least one of the foregoing substances is added.

The present invention will hereunder be described in more detail with reference to the following Examples and Comparative Examples. The following magnesium alloys were used in the following Examples and Comparative Examples:

Magnesium Alloy 1: Mg—5Al—2Ca—2RE—0.2Mn

Magnesium Alloy 2: Mg—5Al—4Ca—0.2Mn

Magnesium Alloy 3: Mg—5Al—4RE—0.2Mn

Magnesium Alloy 4: Mg—5Al—8Si—0.2Mn

Magnesium Alloy 5: Mg—9Al—2RE—1Si—0.05Ca—0.02Mn

Magnesium Alloy 6: Mg—5Al—0.5RE—0.1Si—0.1Ca—0.02Mn

Magnesium Alloy 7: Mg—2Al—2Ca—0.2Mn

Magnesium Alloy 8: Mg—5Al—3Ca—0.2Mn

Magnesium Alloy 9: Mg—5Al—4RE—0.2Mn—0.05Ca

Magnesium Alloy 10: Mg—5Al—2Si—0.5RE—0.2Mn

Magnesium Alloy 11: Mg—9Al—2Ca—2RE—1Si—0.2Mn

Magnesium Alloy 12: Mg—5Al—4Ca—1RE—0.2Mn

EXAMPLES 1 to 7 and

Comparative Examples 1 to 4

In Example 1, a box-like article made on an experimental basis having a size of 300 mm×300 mm×180 mm and a thickness of 3 mm, which was an imitation of a motorcar part, was casted using an alloy 1 and 650t Machine available from UBE Co., Ltd. as a cold chamber type die-casting machine, under the following conditions: a molten alloy temperature of 700° C.; a rate of charging the molten metal into the cavity of 5/100 second; an intensified pressure, after charging, of 500 kgf/cm$^2$; a mold temperature of 200° C.; and an air pressure in the mold during the die-casting of 50 mmHg. The results thus obtained are listed in the following Table 1. On the other hand, Examples 2 to 7 and Comparative Examples 1 to 4 were carried out by changing the casting conditions from the standard ones defined above to those specified in the following Table 1 (the casting conditions, which were not clearly specified in Table 1, remained unchanged, i.e., were identical to the standard ones). These results are also summarized in Table 1.

TABLE 1

| Ex. No. | Alloy No. | Casting Conditions | Results of Casting | Judgment |
|---|---|---|---|---|
| 1 | 1 | Standard | Good | Pass |
| 1* | 1 | Molten metal Temperature: 630° C. | Insufficient Charging | Fail |
| 2* | 1 | Molten metal Temperature: 780° C. | Uncontrollable Molten metal Burning | Fail |
| 3* | 7 | Charging Velocity: 15/100 sec | Insufficient Charging | Fail |
| 4* | 2 | Intensified Pressure: 150 kgf/cm$^2$ | Hot tearing is observed | Fail |
| 2 | 2 | Charging Velocity: 2/100 sec | Good | Pass |
| 3 | 3 | Intensified Pressure: 350 kgf/cm$^2$ | Good | Pass |
| 4 | 4 | Molten metal Temperature: 740° C. | Good | Pass |
| 5 | 5 | Molten metal Temperature: 660° C. | Good | Pass |
| 6 | 6 | Standard | Good | Pass |
| 7 | 7 | Molten metal Temperature: 720° C. | Good | Pass |

*Comparative Example.

EXAMPLES 8 to 12 and

Comparative Examples 5 to 9

In these Examples and Comparative Examples, die cast products, as an article made on an experimental basis, susceptible to the shrinkage tearing were produced, which had a box-like shape similar to that produced in Example 1, but had four bottom corners whose thickness was changed from 3 mm to 10 mm. In Example 8, a box-like die cast product having the same size used in Example 1 except for the thickness of the four bottom corners was produced using an alloy 1 and 650t Machine available from UBE Co., Ltd. under the following casting conditions: a molten alloy temperature of 700° C.; a rate of charging the molten metal into the cavity of 5/100 second; an intensified pressure, after charging, of 500 kgf/cm$^2$; a standard mold temperature of 250° C.; a mold temperature at the portions having varying thickness of 230° C. (this was adjusted by local cooling of the mold); and an air pressure in the mold during the die-casting of 50 mmHg. In addition, a talc-containing releasing agent (available from HANANO SHOJI) was applied to the inner wall of the mold. The results thus obtained are listed in the following Table 2. On the other hand, Examples 9 to 12 and Comparative Examples 5 to 9 were carried out by changing the casting conditions from the standard ones defined above to those specified in the following Table 2 (the casting conditions, which were not clearly specified in Table 2, remained unchanged, i.e., were identical to the standard ones). These results are also summarized in Table 2.

TABLE 2

| Ex. No. | Alloy No. | Casting Conditions | Results of Casting | Judgment |
|---|---|---|---|---|
| 8 | 1 | Standard | Good | Pass |
| 5* | 1 | The air pressure in the mold is not reduced | Insufficient Charging | Fail |
| 9 | 1 | The air pressure in the mol: 150 mmHg | Good | Pass |
| 6* | 2 | Local cooling at 245° C. | Shrinkage tearing is caused at the portion where the thickness is changed | Fail |
| 10 | 5 | Mold temperature: 150° C. | Good | Pass |
| 7* | 7 | Mold temperature: 100° C. | Insufficient Charging | Fail |
| 11 | 7 | Mold temperature: 330° C. | Good | Pass |
| 8* | 5 | Mold temperature: 370° C. | Hot tearing is observed | Fail |
| 9* | 2 | Standard | Penetration is caused at 95 shots | allow-able |
| 12 | 2 | MgO is added to the releasing agent | Good | Pass |

*Comparative Example.

Separately, the same procedures used in Example 12 were repeated except that graphite, BN, water glass, mica, silica gel or MgOH was substituted for the MgO used in the talc type releasing agent used in Example 12 and that the resulting releasing agent was applied to the mold to carry out die-casting. As a result, there was not observed any penetration in all of the cases thus examined.

EXAMPLES 13 to 15 and

Comparative Examples 10 to 11

In Example 13, the alloy 1 was melted using a closed melting furnace, the temperature of the molten metal was maintained at 700° C. and then dried air containing 0.2% by volume of $SF_6$ was circulated over the molten metal. The molten metal was pumped out at a position 150 mm apart from the molten metal surface and supplied to a cold chamber type die-casting machine (650t Machine available from UBE Co., Ltd.). A box-like product similar to that produced in Example 1 as a product on a trial basis was produced under the following conditions: a velocity of charging into the mold cavity of 5/100 second, an intensified pressure after the charging of 500 kgf/cm$^2$, a mold temperature of 250° C., that at the portion where the thickness was changed of 230° C. (this temperature was adjusted by local cooling), and an air pressure in the mold, during die-casting, of 50 mmHg, while a talc-containing releasing agent (available from HANANO SHOJI K.K.) was applied to the inner wall of the mold. The results thus obtained are summarized in the following Table 3.

TABLE 3

| Ex. No. | Alloy No. | Casting Conditions | Results of Casting | Judgment |
|---|---|---|---|---|
| 13 | 1 | Standard | Good | Pass |
| 14 | 2 | 0.2% $SO_2$ was substituted for $SF_6$ | Good | Pass |
| 15 | 3 | 50% $CO_2$ was substituted for dried air | Good | Pass |
| 10* | 3 | Open melting furnace was used | It was impossible to control slight burning of molten metal | allowable |
| 11* | 1 | Molten metal was pumped out from the molten metal surface | Entrainment of oxides was observed | allowable |

*Comparative Example.

EXAMPLE 16

The mold was planed such that it satisfied the following requirements:

The number of gates was 4 and runners were disposed in such a manner that they directly connected the sprue to every gates;

The length of the gate-free portion existing between the neighboring gates was set at 5 mm;

The volume of every runners each starting from sprue to the corresponding gate were identical to one another;

The cross sectional area of each gate was set in such a manner that it was proportional to the volume of the molten metal to be charged through the gate;

The overall cross sectional area of each runner from the sprue to the corresponding gate was maintained constant in the direction along which the molten metal flew; and The shape of the runner was so planed to have a diameter of not less than R15.

A box-like article made on an experimental basis having a size of 300 mm×300 mm×180 mm and a thickness of 3 mm, which was an imitation of a motorcar part, was casted using the foregoing mold plan and alloys 8 to 11, which was highly sensitive to hot tearing, and 650t Machine available from UBE Co., Ltd. as a cold chamber type die-casting machine, under the following conditions: a molten alloy temperature of 700° C.; a rate of charging the molten metal into the cavity of 5/100 second; an intensified pressure, after charging, of 500 kgf/cm$^2$; a mold temperature of 200° C.; and an air pressure in the mold during the die-casting of 40 mmHg. As a result, it was found that there were not observed any hot tearing in all of the four die-casting products at all.

EXAMPLE 17

Die cast products, as an article made on an experimental basis, susceptible to the shrinkage tearing were produced using an alloy 12. Each product had a box-like shape similar to that produced in Example 16, but had four bottom corners whose thickness was changed from 3 mm to 10 mm. As a result, it was found that shrinkage tearing was observed at the periphery of the portion whose thickness was changed in a probability of about 10% and there were observed penetration every 100 shots to 300 shots at portions in which the gate were penetrated into the products.

Thus, the mold portions wherein the thickness was changed were cooled to 230° C. (the difference between the portions and the circumferential portions of the mold was set at 20° C.), as a measure against the shrinkage tearing, to thus inhibit any occurrence of shrinkage tearing.

Alternatively, the casting was carried out after application of a releasing agent to which BN had been added to the portions where the penetration was observed, as a measure against the penetration. In this case, the occurrence of any penetration could likewise be inhibited. Moreover, the same effect could be attained when graphite, water glass, mica, silica gel, magnesium hydroxide or magnesium oxide was substituted for the BN.

EXAMPLES 18 to 24

Either of alloys 1 to 6 was melted using a closed melting furnace and the temperature (A) of the resulting molten metal present in a molten metal-accommodating pot was maintained at the level specified in the following Table 4.

The cold chamber type die-casting machine used herein was 650t Machine available from UBE Co., Ltd. and the sleeve of the die-casting machine used was one whose material was specified in Table 4 (MC is a metal ceramic comprising a titanium alloy on which an SiN ceramic is compounded) and which had a thickness as shown in Table 4 and the sleeve was heated to the temperature specified in Table 4. The siphon system was adopted as the automatic molten metal-supply system from the molten metal-accommodating pot to the sleeve and the siphon tube was heated to the temperature specified in Table 4. In addition, the temperatures of the molten metal were determined at the inlet of the sleeve and the gates (B). The results are summarized in Table 4. The differences (A–B) in the temperature between the molten metal in the pot and that present in the gates are also listed in Table 4.

A box-like article made on an experimental basis having a size of 300 mm×300 mm×180 mm and a thickness of 3 mm, which was an imitation of a motorcar part, was casted under the following conditions: a mold temperature of 200° C.; an air pressure in the mold during the die-casting of 50 mmHg; a rate of charging the molten metal into the cavity of 5/100 second; and an intensified pressure, after charging, of 500 kgf/cm$^2$. In this connection, a talc-containing releasing agent (available from HANANO SHOJI K.K.) was applied to the inner wall of the mold. The results thus obtained are summarized in Table 4.

TABLE 4

| Example No. | 18 | 19 | 20 | 21 | 22 | 23 | 24 |
|---|---|---|---|---|---|---|---|
| Alloy No. | 1 | 2 | 3 | 4 | 5 | 6 | 6 |
| Molten metal temperature A in pot, ° C. | 680 | 680 | 680 | 720 | 650 | 680 | 740 |
| Tube-heating temperature, ° C. | 680 | 680 | 680 | 720 | 650 | 680 | 730 |
| Molten metal temperature at sleeve inlet, ° C. | 680 | 680 | 680 | 720 | 650 | 680 | 730 |
| Material for sleeve/Thickness | MC/15 mm | MC/15 mm | MC/15 mm | MC/15 mm | MC/15 mm | MC/15 mm | MC/15 mm |
| Sleeve-heating temperature, ° C. | 400 | 400 | 400 | 400 | 400 | 400 | 400 |
| Molten metal temperature B at gate, ° C. | 640 | 640 | 640 | 670 | 610 | 640 | 710 |
| Temperature difference, A – B, K | 40 | 40 | 40 | 50 | 40 | 40 | 30 |
| Quality of castings | Good | Good | Good | Good | Good | Good | Good |

As has been described above in detail, in the method for die-casting a magnesium alloy comprising calcium, a rare earth metal or silicon and excellent in low temperature and high temperature strength, a die cast product free of any hot tearing, shrinkage tearing and shrinkage cavity can be produced by appropriately specifying injection conditions, mold conditions, conditions for melting a magnesium alloy and mold plan in the cold chamber type die-casting machine, or by appropriately controlling the temperature of the molten metal from the molten metal-accommodating pot to the gate portion of the machine.

What is claimed is:

1. A method for die-casting a magnesium alloy, which comprises the step of casting a die cast product free of any hot tearing, shrinkage tearing and shrinkage cavity starting from a magnesium alloy comprising i) 1 to 10% by weight of aluminum;

ii) at least one member selected from the group consisting of 0.2 to 5% by weight of a rare earth metal, 0.02 to 5% by weight of calcium and 0.2 to 10% by weight of silicon;

iii) not more than 1.5% by weight of manganese, and iv) the balance of magnesium and inevitable impurities, using a cold chamber die-casting machine, by a) maintaining ,a temperature of the molten magnesium alloy from 650 to 750° C.;

b) setting a charging velocity of the molten metal from 1/100 to 10/100 second; and c) setting an intensified pressure after the charging at a level of not less than 200 kgf/cm$^2$$_1$, wherein a plurality of gates are provided per cavity, each gate is directly connected to each of a plurality of separate runners, each runner directly connects a sprue to each gate, wherein the plurality of gates are disposed so that the molten metal for flow in each runner is uniform with the metal flow in the other runners and a distance of a gate-free portion between two neighboring gates is set at a distance of not more than 10 mm.

2. The die-casting method ads set forth in claim 1 wherein the mold satisfies at least one of the following requirements: the volume of each runner connecting the sprue to each gate is identical to those of the other runners; the cross sectional area of each gate is proportional to the volume of the mold to be charged through the gate; and the total cross sectional area of each runner extending from the sprue to each gate is maintained constant in the direction of the molten metal flow or continuously reduced along the direction.

3. The die-casting method as set forth in claim 1 wherein the mold satisfies the following requirement: the velocity of the molten metal, which flows from the gate to the mold cavity, is set to such a level that the velocity difference in the direction of the gate width is not more than 1 m/sec on the basis of the measurement or calculation of the molten metal flow.

4. A method for die-casting a magnesium alloy, which comprises the step of casting a die cast product free of any hot tearing, shrinkage tearing and shrinkage cavity starting from a magnesium alloy comprising i) 1 to 10% by weight of aluminum;

ii) at least one member selected from the group consisting of 0.2 to 5% by weight of a rare earth metal, 0.02 to 5% by weight of calcium and 0.2 to 10% by weight of silicon;

iii) not more than 1.5% by weight of manganese, and iv) the balance of magnesium and inevitable impurities, using a cold chamber die-casting machine, and a) maintaining a mold temperature from 150 to 350° C.;

b) setting the temperature of the mold surface at a cavity portion in which the die cast product is susceptible to shrinkage tearing at a level of not less than 10K higher than that of the noncavity portions thereof;

c) controlling the air pressure within the mold during the die-casting step to not more than 100 mmHg; and d) applying an additive for a releasing agent onto the inner wall of the mold at least one member selected from the group consisting of graphite, BN, water glass, mica, silica gel, magnesium hydroxide and magnesium oxide, wherein a plurality of gates are provided per cavity, each gate is directly connected to each of a plurality of separate runners, each runner directly connects a sprue to each gate, wherein the plurality of gates are disposed so that the molten metal flow in each runner is uniform with the metal flow in the other runners and a distance of a gate-free portion between two neighboring gates is set at a distance of not more than 10 mm.

5. The die-casting method as set forth in claim 4 wherein the casting is carried out, while the following conditions are further satisfied:

a) maintaining the temperature of a molten magnesium alloy is from 650 to 750° C.;

b) setting the charging velocity of the molten metal from 1/100 to 10/100 second; and c) setting the intensified pressure after the charging at a level of not less than 200 kgf/cm$^2$.

6. The die-casting method as set forth in claim 4 wherein the mold satisfies at least one of the following requirements: the volume of each runner connecting the sprue to each gate is identical to those of the other runners; the cross sectional area of each gate is proportional to the volume of the mold to be charged through the gate; and the total cross sectional area of each runner extending from the sprue to each gate is maintained constant in the direction of the molten metal flow or continuously reduced along the direction.

7. The die-casting method as set forth in claim 4 wherein the mold satisfies the following requirement: the velocity of the molten metal, which flows from the gate to the mold cavity, is set to such a level that the velocity difference in the direction of the gate width is not more than 1 m/sec on the basis of the measurement or calculation of the molten metal flow.

8. A method for die-casting a magnesium alloy, which comprises the step of casting a die cast product free of any hot tearing, shrinkage tearing and shrinkage cavity starting from a magnesium alloy comprising i) 1 to 10% by weight of aluminum;

ii) at least one member selected from the group consisting of 0.2 to 5% by weight of a rare earth metal, 0.02 to 5% by weight of calcium and 0.2 to 10% by weight of silicon;

iii) not more than 1.5% by weight of manganese, and iv) the balance of magnesium and inevitable impurities, using a cold chamber die-casting machine, by a) using a closed melting furnace, in which a protective atmosphere for inhibiting combustion and oxidation is established over the surface of the molten magnesium alloy; and b) pumping the molten magnesium alloy out at a position not less than 100 mm apart from the surface of the molten alloy, to thus inhibit any oxidation of the molten magnesium alloy, to improve the flowability thereof and to inhibit any entrainment of oxides and formation of film play, wherein a plurality of gates are provided per cavity, each gate is directly connected to each of a plurality of separate runners, each runner directly connects a sprue to each gate, wherein the plurality of gates are disposed so that the molten metal flow in each runner is uniform with the metal flow in the other runners and a distance of a gate-free portion between two neighboring gates is set at a distance of not more than 10 mm.

9. The die-casting method as set forth in claim 8 wherein the casting is carried out, while the following conditions are further satisfied:

a) the temperature of the molten magnesium alloy is maintained at 650 to 750° C.;

b) the charging velocity of the molten metal is set at 1/100 to 10/100 second; and c) the intensified pressure after the charging is set at a level of not less than 200 kgf/cm$^2$.

10. The die-casting method as set forth in claim 8 wherein the casting is carried out, while the following conditions are further satisfied:

a) the mold temperature is maintained at 150 to 350° C.;

b) the temperature of the mold surface at cavity portion in which the die cast product is susceptible to shrinkage tearing is set at a level of not less than 10K higher than that of the peripheral portions thereof;

c) the air pressure within the mold during the die-casting step is controlled to not more than 100 mmHg; and d) an additive for a releasing agent to be applied onto the inner wall of the mold is at least one member selected from the group consisting of graphite, BN, water glass, mica, silica gel, magnesium hydroxide and magnesium oxide.

11. The die-casting method as set forth in claim 10 wherein the casting is carried out, while the following conditions are further satisfied:

a) the temperature of the molten magnesium alloy is maintained at 650 to 750° C.;

b) the charging velocity of the molten metal is set at 1/100 to 10/100 second; and c) the intensified pressure after the charging is set at a level of not less than 200 kgf/cm$^2$.

12. The die-casting method as set forth in claim 8 wherein the mold satisfies at least one of the following requirements: the volume of each runner connecting the sprue to each gate is identical to those of the other runners; the cross sectional area of each gate is proportional to the volume of the mold to be charged through the gate; the total cross sectional area of each runner extending from the sprue to each gate is maintained constant in the direction of the molten metal flow or continuously reduced along the direction.

13. The die-casting method as set forth in claim 8 wherein the mold satisfies the following requirement: the velocity of the molten metal, which flows from the gate to the mold cavity, is set to such a level that the velocity difference in the direction of the gate width is not more than 1 m/sec on the basis of the measurement or calculation of the molten metal flow.

14. A method for die-casting a magnesium alloy, which comprises the step of casting a die cast product free of any hot tearing, shrinkage tearing and shrinkage cavity starting from a magnesium alloy comprising i) 1 to 10% by weight of aluminum;

ii) at least one member selected from the group consisting of 0.2 to 5% by weight of a rare earth metal, 0.02 to 5% by weight of calcium and 0.2 to 10% by weight of silicon;

iii) not more than 1.5% by weight of manganese, and iv) the balance of magnesium and inevitable impurities, by maintaining the temperature of the magnesium alloy at the gate portions of the cold chamber die-casting machine at 590 to 720° C. and maintaining the difference in temperature between the molten metal in the molten metal-accommodating pot and that present in the gate portions to not more than 105K, wherein a plurality of gates are provided per cavity, each gate is directly connected to each of a plurality of separate runners, each runner directly connects a sprue to each gate, wherein the plurality of gates are disposed so that the molten metal flow in each runner is uniform with the metal flow in the other runners and a distance of a gate-free portion between two neighboring gates is set at a distance of not more than 10 mm.

15. The die-casting method as set forth in claim 14 wherein a siphon type, mechanical pump type, reduced pressure type or pressurized pump type, or electromagnetic pump type system is used as a molten metal supply-molten metal-pouring system for transferring the molten metal from the molten metal-accommodating pot to the sleeve of the cold chamber type die-casting machine.

16. The die-casting method as set forth in claim 15 wherein the sleeve of the die-casting machine is produced from a material whose thermal conductivity is not more than 0.085 cal/cm·s·°C. and whose thickness is not less than 10 mm and wherein the sleeve portion is heated to a temperature of not less than 100° C.

* * * * *